US010053839B2

(12) United States Patent
Serrurier et al.

(10) Patent No.: US 10,053,839 B2
(45) Date of Patent: Aug. 21, 2018

(54) RETAINER SYSTEM FOR GROUND-ENGAGING TOOL

(71) Applicant: Caterpillar Inc., Peoria, IL (US)

(72) Inventors: Doug Serrurier, Morton, IL (US); Eric Sinn, East Peoria, IL (US); Jason Jura, Peoria, IL (US); Mihai Balan, Dunlap, IL (US); Scott A. Schick, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 112 days.

(21) Appl. No.: 15/179,251

(22) Filed: Jun. 10, 2016

(65) Prior Publication Data

US 2017/0356166 A1 Dec. 14, 2017

(51) Int. Cl.
*E02F 9/28* (2006.01)

(52) U.S. Cl.
CPC ..... *E02F 9/2825* (2013.01); *E02F 9/28* (2013.01); *E02F 9/2833* (2013.01); *E02F 9/2858* (2013.01)

(58) Field of Classification Search
CPC ..... E02F 9/28; E02F 9/2825; E02F 9/2833; E02F 9/2858
See application file for complete search history.

(56) References Cited

U.S. PATENT DOCUMENTS 7,121,022 B2 * 10/2006 Bierwith ..... E02F 9/2833 37/455
8,122,623 B1 2/2012 Hughes
8,127,475 B2 * 3/2012 Harder ..... E02F 9/2825 37/452
9,027,268 B2 5/2015 Campomanes et al.
9,074,350 B2 7/2015 LaHood et al.
2004/0216334 A1 11/2004 Emrich
2012/0210612 A1 * 8/2012 Harder ..... E02F 9/2825 37/455
2014/0259810 A1 9/2014 LaHood
2014/0352182 A1 * 12/2014 LaHood ..... E02F 9/2825 37/455
2015/0233095 A1 * 8/2015 Renski ..... E02F 9/2825 37/455
2015/0247306 A1 * 9/2015 Kunz ..... E02F 9/2891 37/455
2015/0368882 A1 * 12/2015 Hughes ..... E02F 9/2825 37/455

FOREIGN PATENT DOCUMENTS

AU 2013200161 4/2015

* cited by examiner

*Primary Examiner* — Matthew D. Troutman
(74) *Attorney, Agent, or Firm* — Leydig, Voit & Mayer, Ltd.

(57) ABSTRACT

A ground-engaging tool system includes an adapter attachable to a work implement and a ground-engaging tip that is releasably connectable to the adapter. To releasably mate the adapter and the tip, the adapter may include a projecting lug post that locks and unlocks with a rotatable, latch-like retainer in the tip. The lug post may be a frustum or frustoconical structure having a truncated flat and an exterior side surface that intersect at a peripheral edge. The shape of the truncated flat, peripheral edge, and exterior side surface may further be delineated by a first radius and a second radius of different dimensions, or by radii having first and second centers that are not coincident in location on the truncated flat.

19 Claims, 7 Drawing Sheets

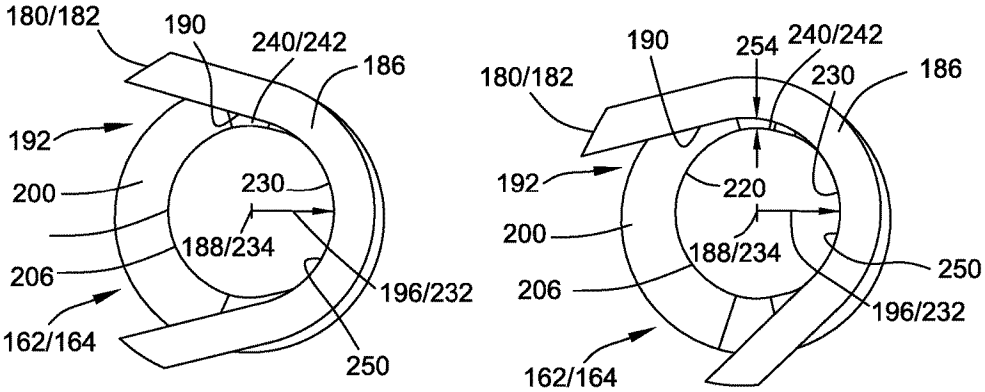
FIG. 8
FIG. 9
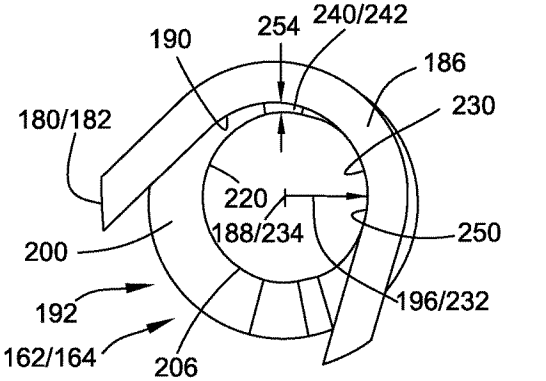
FIG. 10
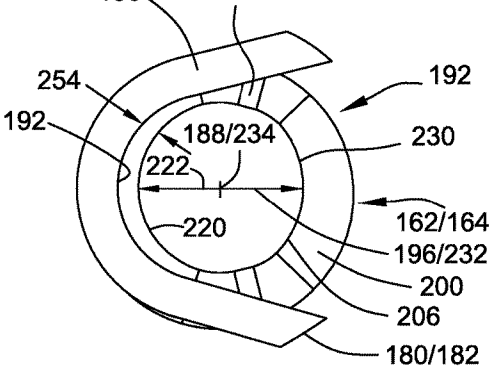
FIG. 13
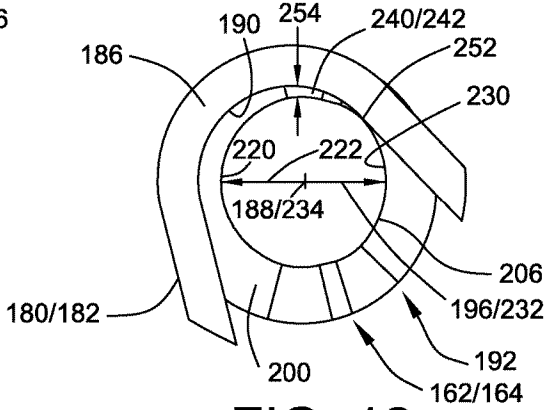
FIG. 12
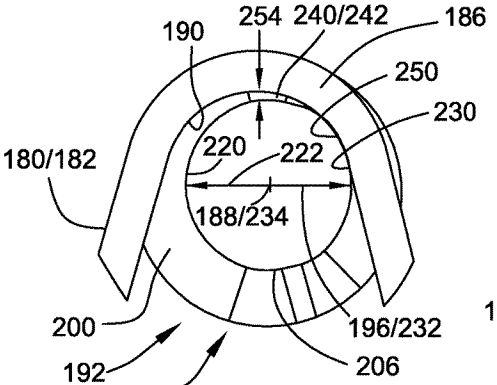
FIG. 11

RETAINER SYSTEM FOR GROUND-ENGAGING TOOL

TECHNICAL FIELD

This patent disclosure relates generally to ground-engaging tools and, more particularly to retaining systems for removably attaching the ground-engaging tools to various earth-working machines.

BACKGROUND

Earth-working machines, such as, for example, excavators, wheel loaders, hydraulic mining shovels, cable shovels, bulldozers, and draglines, are generally used for digging or ripping into the earth or rock and/or moving loosened work material from one place to another at a worksite. These earth-working machines include various earth-working implements, such as a bucket or a blade, for excavating, scooping, and moving the earthen work material. These implements may be subjected to extreme wear and/or damage from the impacts and abrasion experienced during the earth-working applications.

To facilitate penetration and removal of earthen materials, the earth-working implements may be equipped with ground-engaging tools such as teeth, edge protectors, and other cutting tools that are arranged where the ground-engaging tools will encounter the most damaging impacts and abrasion. Because the ground-engaging tools themselves are subject to wear and damage, they may be designed to be removable and replaceable with new tools as part of the maintenance of the earth-working implement. To enable removal and replacement of the ground-engaging tools, the tools typically include or may be designed with retainer systems that attach the tools to the earth-working implements.

For example, one type of retainer system is described in U.S. Pat. No. 9,074,350 ("the '350 patent") assigned to the applicant of the present disclosure. The '350 patent describes a ground-engaging tool assembly in which a supporting adapter is permanently attached to the earth-working implement and a wear member, such as a ground-engaging tip, is releasably secured to the adapter via a locking mechanism. In particular, the ground-engaging tip has a cavity disposed therein that receives a correspondingly shaped portion of the adapter. When the adapter slides into the cavity, a lug post projecting from a lateral surface of the adapter can align and mate with a notch formed in the sidewall of the cavity. Assembled into the notch may be a rotatable collar-like retainer having a semi-circular latch collar and that can be accessed through an aperture or opening disposed in the cavity sidewall. To lock the adapter and ground-engaging tip together, the retainer can be turned using a ratchet tool or Allen wrench inserted through the aperture so the collar slides around the lug post thereby preventing the adapter from backing out of the cavity disposed in the ground-engaging tip. To release the components, the retainer can be turned back to its unlocked position freeing the lug post. Like the '350 patent, the present disclosure is directed to a releasable retainer system for attaching a ground-engaging tool to an earth-working implement.

SUMMARY

The disclosure describes, in one aspect, a ground-engaging tool system including an adapter with an attachment structure for attachment to a work implement and a ground-engaging tip releasably connectable to the adapter. The adapter includes a support nose extends forward from the attachment structure and that has at least a first adapter surface with at least a first lug post projecting there from. The lug post is generally shaped as a frustum with an exterior side surface delineated by at least a smaller first radius and a larger second radius. To mate with the adapter, the ground-engaging tip includes a cavity disposed therein configured for receiving the support nose. A retainer is configured to be rotatably accommodated within a notch located inside the cavity. The retainer further includes a latch collar having a curved interior surface delineated by a latch collar radius that is generally equal in dimension to the second radius. The retainer can rotate around the lug post so that the curved interior surface and exterior side surface contact each other.

In another aspect, the disclosure describes a lug post projecting from an adapter and configured to latch and unlatch with a rotatable retainer having a curved interior surface on a ground-engaging tool. The lug post is shaped as a frustum and includes a base on the adapter and a truncated flat above the base. An exterior side surface extends between the base and the truncated flat and further forms a peripheral edge with the truncated flat. The peripheral edge has a first arc with a first center and a second arc with a second center, wherein the first and second centers are not coincident in location on the truncated flat.

In yet another aspect, the disclosure describes an adapter for a ground-engaging tool designed for releasable connection with a ground-engaging tip. The adapter includes an attachment structure configured to attach to a work implement and a support nose extending from the attachment structure. The support nose has a first adapter surface and a first lug post projecting from the first adapter surface. The lug post is generally shaped as a frustum with an exterior side surface and a truncated flat intersecting at a peripheral edge. The peripheral edge is delineated in part by at least a first radius originating from a first center on the truncated flat and a second radius originating from a second edge on the truncated flat, wherein the first center and the second center are not coincident in location on the truncated flat.

BRIEF DESCRIPTION OF THE DRAWINGS

FIGS. 8-13 are top plan views of the lug post and the retainer as the retainer is rotated from the locked position to an unlocked position with respect to the lug post.

DETAILED DESCRIPTION

Figure 1:
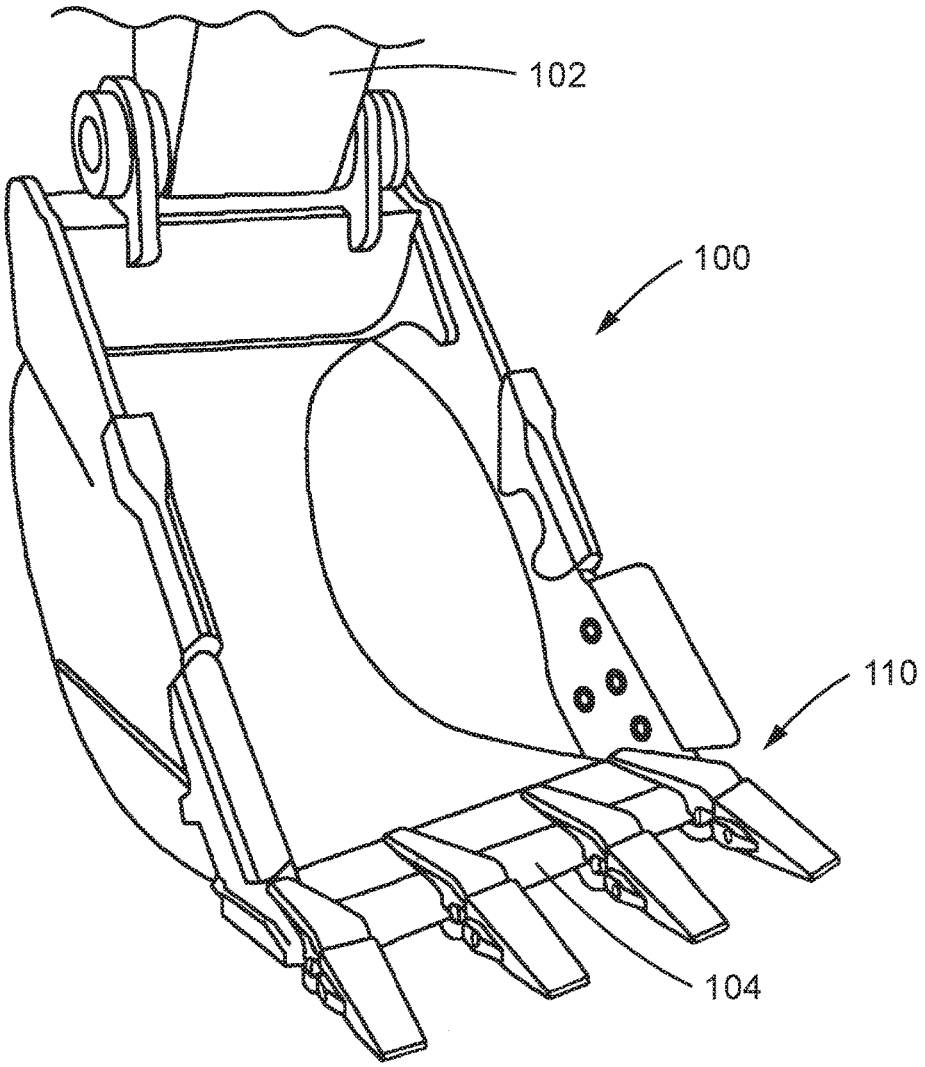
FIG. 1 is a perspective view of a work implement in the form of a loader bucket having a plurality of ground-engaging tools attached thereto along an edge.

Now referring to the drawings, wherein like reference numbers refer to like elements, there is illustrated in FIG. 1 an example of an earth-working implement in the form of an excavator bucket 100 that may be pivotally attached to the hydraulically actuated dipper and boom linkage 102 of the excavator. The bucket 100 can be maneuvered to impact and penetrate into the ground or other material, scoop a portion of the material, and move the material to another location. To facilitate penetration into the material, the bucket 100 can include a distal base edge 104 along which are attached in a spaced-apart relation a plurality of ground-engaging tools 110 in the form of sharpened, wedge-like tooth assemblies. The toothed configuration of the ground-engaging tools 110 can fracture and penetrate into hardened materials such as concrete, rock, or packed earth, thereby assisting the ground-moving operation. While various embodiments of the present disclosure will be described in connection with a particular ground-engaging tool, it should be understood the present disclosure may be applied to, or used in connection with, any other type of ground-engaging tools or components. Further, it should be understood that one or more features described in connection with one embodiment can be implemented in any of the other disclosed embodiments unless otherwise specifically noted.

Figure 2:
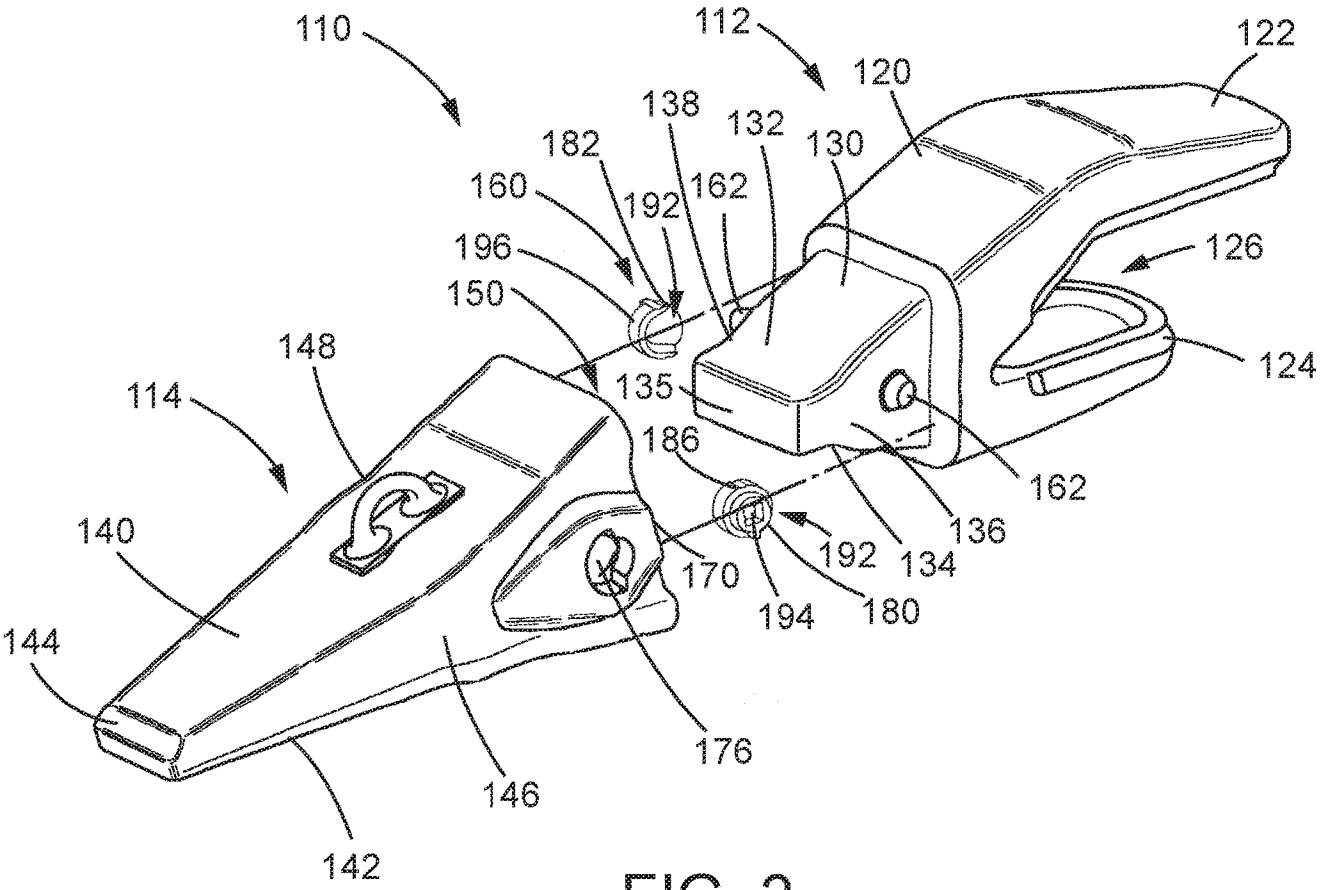
FIG. 2 is a perspective view of a multi-component ground-engaging tool including an adapter that may be more permanently attached to the implement and a replaceable ground-engaging tip.

Referring to FIG. 2, there is illustrated an embodiment of the ground-engaging tool 110 designed in accordance with the disclosure to enable removal and replacement of the portion of the tool that may be subjected to the most wear and damage during operation. In this embodiment, the ground-engaging tool 110 includes an adapter 112 that may be securely attached to the work implement and a ground-engaging tip 114 that releasably attaches to the adapter. Because the ground-engaging tip 114 is subjected to the most wear and abrasion from engaging the material, and may break more frequently than the adapter 112, the releasable attachment of the two components allows for removal and replacement of the ground-engaging tip to ensure the work implement is in optimal condition for the intended operation. Additionally, the ground-engaging tip 114 may occasionally be detached and changed out for tools of different styles and configurations depending on the characteristics of the materials and operation being performed.

To secure the adapter 112 to the base edge of the bucket or other work implement, the adapter has an attachment structure 120 with a first mounting leg 122 and a second mounting leg 124 projecting rearward with respect to the remainder of the adapter. The first and second mounting legs 122, 124 are arranged in a spaced apart or bifurcated manner so the legs define a recess 126 between them that can receive the base edge of the implement. With the first and second mounting legs 122, 124 positioned on opposite sides of the base edge received in the recess 126, the legs can be secured to the implement using any suitable method to hold the adapter 112 in place. For example, fasteners such a threaded bolts or rivets can used to fasten the first and second mounting legs 122, 124 to the base edge while in other embodiments, the first and second mounting legs may be welded to the edge. Hence, compared to the ground-engaging tip 114, the adapter 112 is relatively permanently secured on the work implement, although the disclosure contemplates that occasionally, though less frequently, the adapter itself may need to be removed and replaced. Additionally, in other embodiments, alternative attachment structures may be utilized such as structures comprising a single leg, inserts or sockets, or any other suitable attachment configuration known in the art.

To attach to the ground-engaging tip 114, the adapter 112 can include a block-like support nose 130 that extends forward of the attachment structure 120 and that may be shaped to mate with a corresponding feature on the tip. The shape of the support nose 130 can be provided by a plurality of adapter surfaces arranged to form the block-like structure. For example, in illustrated embodiment, the support nose 130 may have a tapered shape provided by a first inclined adapter surface 132 and a second inclined adapter surface 134 located below and opposite of the first inclined adapter surface, with the inclined adapter surfaces arranged at a sloping or converging angle with respect to each other and unite together at a blunted or rounded edge 135. The remainder of the block-like shape of the support nose 130 may be further delineated by a first lateral adapter side 136 and an oppositely located second lateral adapter side 138 that extend between the converging first and second inclined adapter surfaces 132, 134. In other embodiments, however, the support nose 130 can include any other suitable arrangement of adapter surfaces to provide a three dimensional structure. The adapter 112 may be made from any material suitable for the intended environment such as, for example, cast or machined steel or other metals.

To enable the ground-engaging tip 114 to penetrate material, the tip may also have a wedge-like or tapered shape provided by a first inclined tip surface 140 and a corresponding second inclined tip surface 142 arranged at a converging angle with respect to each other. The first and second inclined tip surfaces 140, 142 may intersect at a relatively sharp penetration edge 144 to complete the tooth-like appearance of the ground-engaging tip 114. The ground-engaging tip 114 may further include a first lateral tip side 146 and a spaced-apart second lateral tip side 148 that extend between and conform to the converging arrangement of the first and second inclined tip surfaces 140, 142. However, in other embodiments, the ground-engaging tip 114 may be configured in different shapes to perform different tasks associated with the work-implement.

Figure 3:
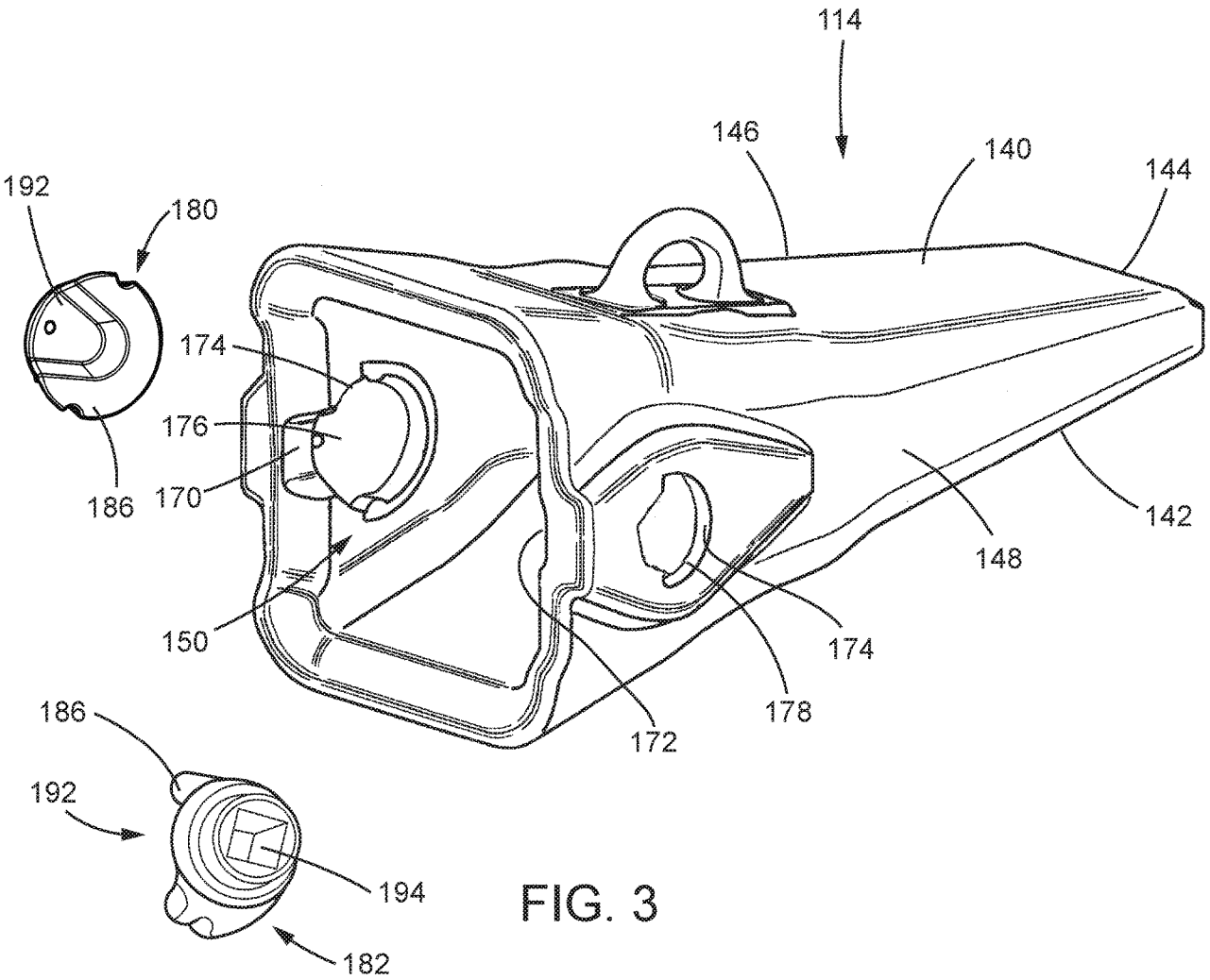
FIG. 3 is a rear perspective view of the ground-engaging tip illustrating the cavity disposed therein and one or more laterally arranged notches that are configured to receive complementary parts of the adapter.

Referring to FIGS. 2 and 3, to mate the adapter 112 and the ground-engaging tip 114 together, the tip can include a cavity 150 disposed inside of it that is configured to receive the support nose 130. Hence, the ground-engaging tip 114 is partially hollow with the cavity 150 delineated between the first and second inclined tip surfaces 140, 142 and the spaced-apart lateral tip sides 146, 148. In various embodiments, the cavity 150 may have a shape that corresponds to the block-like shape of the support nose 130.

To enable the releasable mating of the adapter 112 and the ground engaging tip 114, the two components can be provided with or form together a retainer system 160 that allows the parts to be selectively locked and unlocked together. In a particular embodiment, the retainer system 160 may be configured to releasably engage with corresponding structures formed on the support nose 130, which may be in the form of one or more lug posts that project from the surface of the support nose. For example, a first lug post 162 may project normally from the first lateral adapter side 136 while a second lug post 164 projects in the opposite direction from the second lateral adapter side 138; however, in other embodiments, the lug posts may be present in different numbers and at different locations on the adapter 112. As described more fully below, the lug posts 162, 164 may have various configurations but are generally overall cylindrical or frustum-like in shape. The first and second lug posts 162, 164 can be integrally cast as part of the adapter 112 or may be made as separate items that are connected to the support nose 130 by, for example, threaded posts or the like.

To accommodate the components of the retainer system 160 that engage the lug posts 162, 164, the ground-engaging tip 114 can have corresponding notches formed into the interior walls and exposed to the cavity 150. In the illustrated embodiment, the notches can include a first notch 170 disposed into the interior surface of the first lateral tip side 146 and a second notch 172 disposed in the interior surface of the oppositely arranged second lateral tip side 148. The first and second notches 170, 172 may be formed as depressions into the sides and may each define a generally curved interior surface 174. Moreover, the first and second notches 170, 172 are accessible from the rear of the ground engaging tip 114 proximate the opening of the cavity 150. Hence, when the support nose 130 is inserted into the cavity 150, the first and second lug posts 162, 164 can align with and be received into the respective first and second notches 170, 172. Moreover, the larger dimensioned first and second notches 170, 172 may connect with respective, smaller sized first and second lock apertures 176, 178 which are disposed through the corresponding first and second lateral tip sides 146, 148 such that the cavity 150 is accessible from the exterior of the ground-engagement tip 114.

Figure 4:
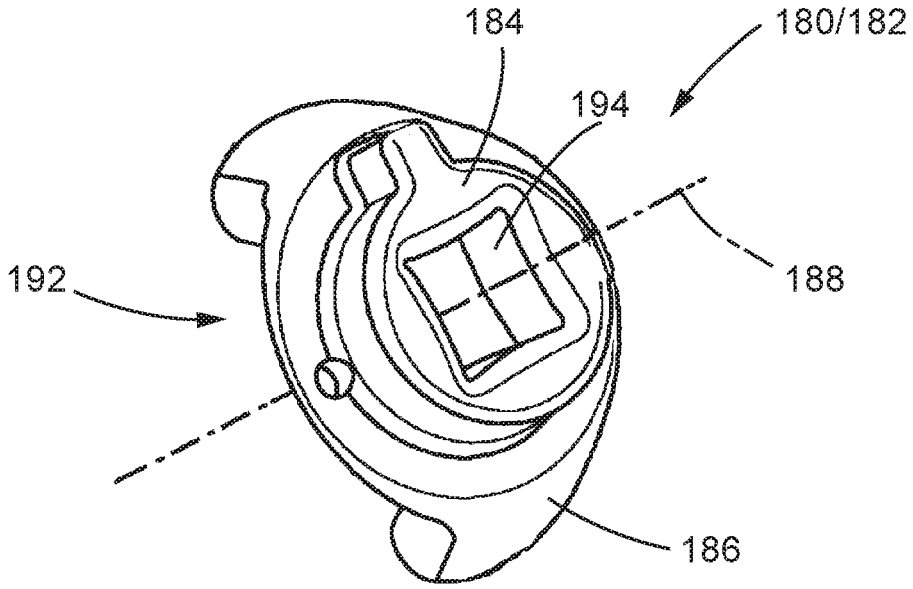
FIG. 4 is a perspective view of a retainer having a curved collar that can be rotatably disposed in the notch of the ground-engaging tip.
Figure 5:
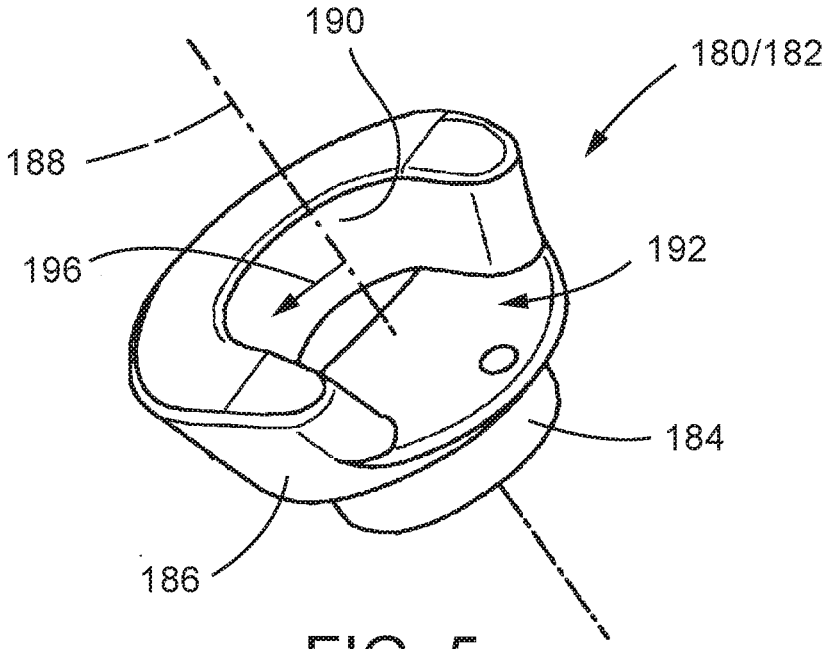
FIG. 5 is a rear perspective view of the retainer illustrating the tool engagement socket disposed therein.

To lock the first and second lug posts 162, 164 into the respective first and second notches 170, 172, the retainer system 160 can include a first retainer 180 and a second retainer 182. The first and second retainers 180, 182 are configured to seat within the respective first and second notches 170, 172 in a manner that enables the retainers to rotate about the respective lug posts. Referring to FIGS. 4 and 5, to enable the retainers 180, 182 to rotate in the notches, each retainer can have a generally circular cap 184 from which extends a semi-circular latch collar 186. More specifically, the latch collar 186 can be a curved, wall-like structure that is disposed partially along and descends normally from the peripheral edge of the circular cap 184. Further, the circular cap 184 and semi-circular latch collar 186 may be arranged substantially concentric about a retainer axis line 188. Because of its wall-like, semi-circular structure, the latch collar 186 can also delineate a curved interior surface 190 that extends partially around the retainer axis line 188 and that similarly defines a latch slot 192 within or between the semi-circular structure. In an embodiment, the curved interior surface 190 can be delineated in part by a latch collar radius 196 that originates from the retainer axis line 188 to provide the curved shaped.

To cause the retainers 180, 182 to rotate with respect to the retainer axis line 188, the circular cap 184 can include a tool engagement socket 194 formed on the side opposite the latch collar 186 that can receive or engage a tool such as an Allen wrench or socket driver. Referring back to FIGS. 2 and 3, when the first and second retainers 180, 182 are installed in the respective first and second notches 170, 172, the semi-circular latch collar 186 can make sliding contact with the curved interior surface 174 while the tool engagement socket 194 is aligned with and accessible through the lock apertures 176, 178. Hence, an operator or maintenance person can twist the retainers 180, 182 about the retainer axis line 188 to rotate the retainers in the notches 170, 172. The sliding surfaces of the latch collar 186 and the curved interior surface 174 of the notches 170, 172 may be complementary in shape and dimension and form a journal bearing at their interface. The interfacing surfaces may be cylindrical or have complementary conical or angled shapes to promote seating or location of the parts. Hence, the exterior shape of the latch collar may be cylindrical or conical as the case may be.

Referring still to FIGS. 2 and 3, the retainers 180, 182 may be initially disposed in the notches 170, 172 such that the latch slot 192 is oriented rearward in a position that may be referred to as the unlocked position. When the support nose 130 is inserted into the cavity 150, the lug posts 162, 164 align with the notches 170, 172 and be received in the latch slots 192 of the retainers 180, 182. The retainers 180, 182 can be rotated 180° by use of the tool engagement socket 194 so that the latch collar 186 slides about the lug posts 162, 164 and is now oriented rearward toward the opening of the cavity 150. This may be referred to as the locked position in which the latch collar 186 traps the lug posts 162, 164 and prevents the adapter 112 and the ground-engaging tip 114 from separating. To release the adapter and ground-engaging tip, the retainers may be rotated another 180° to the unlocked position. In embodiments where the lug posts 162, 164 are frustoconical in shape, the curved interior surface 190 of the latch collar 186 can have a corresponding tapered or angled shape along its extension from circular cap 184 to corresponding with the frustoconical shape.

Figure 6:
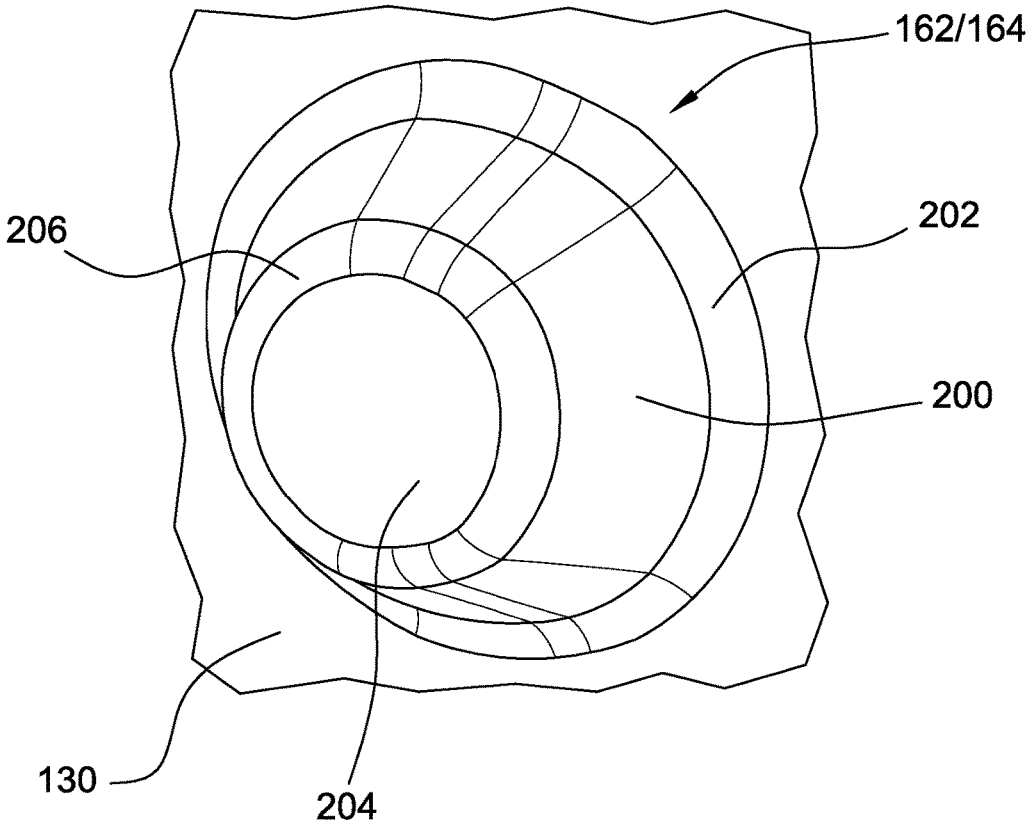
FIG. 6 is a perspective view of an embodiment of a lug post disposed on a lateral surface of the adapter that can be received into the notch and engage with the retainer.
Figure 7:
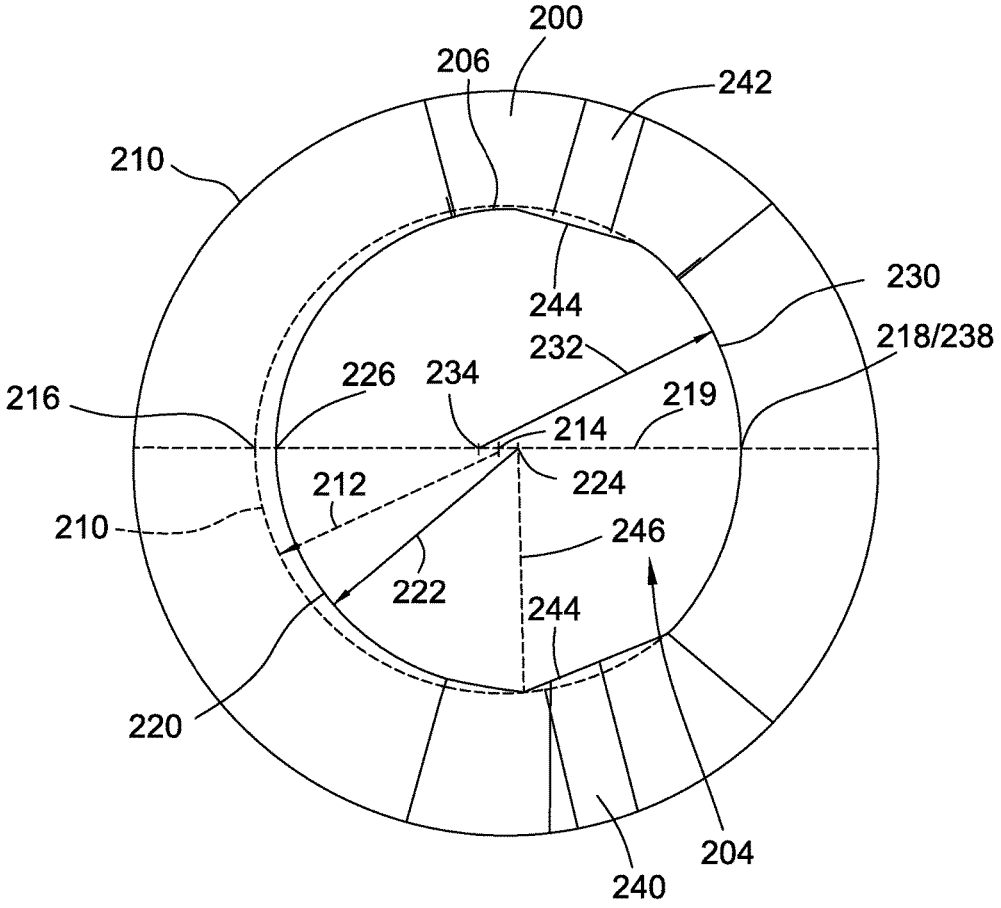
FIG. 7 is a schematic top plan diagram of the lug post illustrating the various dimensions and radii that provide its shape.

Referring to FIGS. 6 and 7, the details of the lug posts 162, 164 that enable it to lock with the retainers are better illustrated. As stated above, in an embodiment, the lug posts 162, 164 may be a frustum having a generally frustoconical shape but can be designed with different dimensioned radii or with radii that have different centers that vary the shape slightly. For example, the lug posts 162, 164 can have a generally conical exterior side surface 200 that tapers from the base 202 where the lug post joins the support nose 130 to the truncated flat 204 that is spaced above the base. Because of the variations of the radii dimensions and center points, a peripheral edge 206 where the truncated flat 204 and the exterior side surface 200 intersect might not be formed as a true circle of a consistent diameter around 360° but that may have different arcs, curves, or edges. Likewise, the exterior side surface 200 descending between the peripheral edge 206 and the base 202 may vary from truly conical. For reference purposes, shown in FIG. 7, a true reference circle 210 having a reference radius 212 originating from a reference center 214 is indicated in dashed lines. The periphery of the reference circle 210 may be intersected at a first reference point 216 and a second reference point 218 located 180° opposite each other by a reference diameter 219 that also passes through the reference center 214. The reference diameter 219 may be twice the value of the reference radius 212. Further, the reference radius 212 and reference diameter 219 may have a consistent dimension that defines the 360° circular periphery of the reference circle 210.

In an embodiment, to cause the lug posts 162, 164 to assume a more oblong or elliptical shape, the radial center of specific portions of the truncated flat 204 may be shifted or offset along the reference diameter 219. For example, the peripheral edge 206 of the truncated flat 204 of may include a first arc 220 that has a first radius 222 equal in dimension to the reference radius 212 (i.e., $R_{ref.}=R_{1st}$) but which originates from a first center 224 that is eccentrically offset or shifted from the reference center 214 (i.e., $C_{ref.}\neq C_{1st}$). Hence, the reference center 214 and the first center 224 may assume different positions along the reference diameter 219. When viewed in plan, the first arc 220 is therefore offset with respect to or sits within the reference circle 210. Likewise, the first arc 220 may have a middle point or first midpoint 226 that is aligned on the reference diameter 219 but that is offset from the first reference point 216 where the reference diameter intersects the reference circle 210. Further, the first arc 220 may extend or sweep in either direction of the first midpoint 226 for about 70° to 80° degrees. Hence, the first arc 220 may correspond to about 140° to about 160° of the peripheral edge 206 of the truncated flat 204.

The peripheral edge 206 of the truncated flat 204 can also include a second arc 230 that can be positioned diametrically opposite to the first arc 220 with respect to the reference diameter 219. The second arc 230 may be characterized by a second radius 232 that originates from a second center 234. To further vary the frustoconical shape, the second center 234 may be eccentrically shifted or offset with respect to both the reference center 214 of the reference circle 210 (i.e., $C_{2nd} \neq C_{ref}$) and the first center 224 of the first arc 220 ($C_{2nd} \neq C_{1st}$); hence, the reference center and the first and second centers are not coincident with each other. In accordance with this embodiment, the second center 234 may be located along the portion of the reference diameter 219 that extends from the reference center 214 in the opposite direction of the location of the first center 224. Hence, the first center 224 may be located closer to the second arc 230 while the second center 234 may be located closer to the first arc 220.

In addition, the dimension of the second radius 232 may be different from the dimension of the reference radius 212 ($R_{1st} > R_{ref.}$) and the first radius 222 ($R_{1st} > R_{2nd}$); for example, the second radius may be dimensionally greater than the equally sized reference radius and first radius. Hence, although the second center 234 is positioned further from the second reference point 218 than the reference center 214, the second arc 230 generated by the second radius 232 passes through the second reference point 218 due to the difference in radial dimensions. In other words, the reference circle 210 and the second arc 230 generated by second radius 232 overlap or are at least tangential proximate the second reference point 218. The second arc 230 may also include a second midpoint 238, which corresponds in position with the second reference point 218, and the second arc may extend or sweep in either angular direction approximately 45° to 55°. Hence, the second arc 230 may correspond to about 70° to about 90° of the peripheral edge 206 of the truncated flat 204.

A result of the foregoing arrangement is that only portions of the peripheral edge 206 of the truncated flat 204 overlap the circumference of the reference circle 210 while others do not. Another result is the dimensional length of the second arc 230 is larger than the dimensional length of the first arc 220 and of the reference circle 210 for a given angle or angular sweep. In other words, because the second radius 232 is larger than the first radius 222, the length of the second arc 230 covered by a 60° sweep of the second radius will be larger than the length of the first arc 220 covered by the same 60° sweep of the first radius. In effect, having a portion of the peripheral edge 206 and the exterior surface 200 associated with it correspond to the second arc 230 and second radius 232 increases the surface area of the lug posts 162, 164 in that region. As described below, this is beneficial when the lug posts engage with the retainers.

To transition the peripheral edge 206 between the first arc 220 and the second arc 230, the lug posts 162, 164 may be formed with a first beveled flat 240 and a second beveled flat 242 that generally follows with the tapered angle of the exterior surface 200 between the peripheral edge 206 and the base 202. The first and second beveled flats 240, 242 cause the peripheral edge 206 of the truncated flat 204 to assume the appearance of a straight line 244 in the transition regions. In an embodiment, an end point of the vertical line 244, and thus the location of the first and second beveled flats 240, 242, can be determined by drawing a reference line 246 from the first center 224 at an approximately 90° angle with respect to reference diameter 219, i.e. vertically downwards in FIG. 7, which may intersect the first arc 220. Hence, the location of the first center 224 on the truncated flat 204 and the location of the straight lines 244 along the peripheral edge 206 are interrelated and may be positioned coextensively with respect to the reference diameter 219. Moreover, the intersection points between the straight line 244 and the first and second arcs 220, 230 may be rounded or formed with smaller radii to eliminate sharpened corners. The first and second beveled flats 240, 242 may be cast into the lug posts 162, 164 or can be formed by grinding or machining the lug posts 162, 164 at the transition points between the first and second arcs 220, 230.

INDUSTRIAL APPLICABILITY

Referring to FIGS. 8-14, there is illustrated the operative effect of the lug posts 160,162 designed in accordance with the disclosure when locked and unlocked by rotation of the retainer 180, 182. The retainers 180, 182 may be designed so that the latch collar radius 196 and the curvature of the curved interior surface 190 disposed interiorly of the latch collar 186 is equal or approximately equal to the curvature determined by the second radius of the lug posts 162, 164. Further, the retainer axis line 188 of the retainer 180, 182 can be positioned to correspond to the second center 234 from which the second radius 232 originates. Hence, the curved interior surface 190 and the portion of the peripheral surface corresponding to the second arc 230 are juxtaposed together when the retainers 180, 182 are in the locked position as shown in FIG. 8. Additionally, it will be appreciated that the exterior side surface 200 of the lug posts 162, 164 and the interior surface 190 of the latch collar 186 are in an abutting or adjacent relationship at this interface. The adjacent arrangement between the curved interior surface 190 and the second arc 230 may continue for substantially the angular sweep or width of the second arc, e.g., about 70° to about 90°, resulting in an arc of contact 250. As illustrated, the arc of contact 250 may be coextensive with the angular width of the second arc 230. The arc of contact 250 between lug posts 162, 164 and latch collar 186 ends at the beveled flats 240, 242 where the peripheral edge 206 and the interior surface 190 begin to separate.

It may be appreciated that a possible advantage of placing the exterior surface 200 of the lug posts 162, 164 in contact with the curved interior surface 190 of the retainers 180, 182 along the arc of contact 250, as opposed to a tangential point, is that a significant amount of friction may be created between the components. That friction may resist relative rotation between the retainers 180, 182 and the lug posts 162, 164, thereby assisting in holding the retainers 180, 182 in the locked position and prevent them from unintentionally rotating to the unlocked position. Another possible advantage is that curved interior surface 190 and the exterior side surface 200 may initially conform in shape along the arc of contact 250 when, for example, new ground-engaging tips are installed. Hence, there is less wear and abrasion than would occur if contact between the retainers 180, 182 and lugs posts 162, 164 occurred at a single point of contact. In such instances, the single point of contact is required to wear down to better distribute the abutting forces between the retainers 180, 182 and lugs posts 162, 164, a process referred to as "seating." In other words, the lugs posts 162, 164 in accordance with the disclosure are pre-seated with the retainers 180, 182.

To unlock the components, the operator may begin rotating the retainers 180, 182 with respect to the lug posts 162, 164 in the counterclockwise direction as illustrated in FIGS. 9-10. This causes the curvature of the interior surface 190 to move with respect to the peripheral edge 206 toward the beveled flat 242 where the interior surface 190 and the exterior side surface 200 separate. Moreover, the wider portion of the latch slot 192 between the semi-circular latch collar 186 begins to shift proximate to and facing towards the second arc 230, resulting in separation between the latch collar 186 and the exterior side surface 200 at this location. The relative rotation between the retainer 180, 182 and the lug posts 162, 164 therefore results in decreasing the arc of contact 250 between the components. In fact, as illustrated in FIG. 12, further relative rotation may result in reducing the arc of contact to a single, tangential point of contact 252. It will be appreciated that a possible advantage of reducing the arc of contact 250 is that the friction between the components will be correspondingly reduced, and there will be less resistance to further rotation of the retainer 180, 182.

As shown in FIGS. 11-14, as relative rotation between the retainer 180, 182 and lug posts 162, 164 continues, the interior curved surface 190 moves opposite to but separated from the first arc 220. The separation results in a gap 254 between the curved interior surface 190 and the first arc 220 of the peripheral edge 206. The gap 254 itself is the result in part of the first radius 222 having a smaller curvature than the curved interior surface 190 determined by the latch collar radius 196 that, as stated above, is equal to the larger second radius 232. The gap 254 also results from the location of the retainer axis line 188 (which corresponds to the rotational axis of the retainer 180, 182) being the same as the location of the second center 234, which is offset toward the first arc 220. It may be appreciated that a possible result of this increasing gap 252 is that friction, and hence resistance, to relative movement between the retainers 180, 182 and the lug posts 162, 164 is further reduced. Another possible result is that dirt or material that manages to become trapped between the interface of the curved interior surface 190 and the exterior side surface 200 can fall away.

When the retainers 180, 182 have been rotated 180° from the locked position shown in FIG. 8 to the unlocked position shown in FIG. 14, the curved interior surface 190 and the exterior surface 200 are completely separated from each other. Further, the second arc 230 is exposed to the gap between the semi-circular ends of the latch collar 186. The lug posts 162, 164 can therefore be removed from the latch slot 192 of the latch collar 186, thereby releasing the components of the ground-engaging tools.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A ground-engaging tool system comprising:

an adapter including an attachment structure configured for attachment to a work implement and a support nose extending from the attachment structure, the support nose having at least a first adapter surface and at least a first lug post projecting from the first adapter surface, the first lug post being generally shaped as a frustum with an exterior side surface delineated by at least a first radius delineating a first arc and a second radius delineating a second arc, the second radius being larger in dimension than the first radius;

a ground-engaging tip including a cavity disposed therein configured for receiving the support nose, the ground-engaging tip including a first notch disposed inside the cavity;

a retainer configured to be rotatably accommodated in the first notch, the retainer including a latch collar having a curved interior surface delineated by a latch collar radius generally equal in dimension to the second radius.

2. The ground-engaging tool system of claim 1, wherein the first lug post includes a truncated flat and the exterior side surface and the truncated flat intersect at a peripheral edge.

3. The ground-engaging tool system of claim 2, wherein the first arc and the second arc are disposed opposite each other.

4. The ground-engaging tool system of claim 3, wherein the first radius originates from a first center located on the truncated flat and the second radius originates from a second center located on the truncated flat.

5. The ground-engaging tool system of claim 4, wherein the first center and the second center are not coincident to each other.

6. The ground-engaging tool system of claim 5, wherein the first lug post is generally frustoconical in shape and the exterior side surface is generally conical in shape.

7. The ground-engaging tool system of claim 1, wherein the support nose include a second adapter surface and a second lug post projecting from the second adapter surface, the second lug post shaped similar to the first lug post.

8. The ground-engaging tool system of claim 7, wherein the ground-engaging tip includes a second notch disposed in the cavity opposite the first notch.

9. The ground-engaging tool system of claim 2, wherein the lug post further comprises a first beveled flat disposed in the exterior side surface and a second beveled flat disposed in the exterior side surface, the first and second beveled flats located between the first and second arcs.

10. A lug post projecting from a side surface of an adapter and configured to latch and unlatch with a rotatable retainer having a curved interior surface delineated by a latch collar radius, the lug post being shaped as a frustum and comprising:

a base at the side surface;

a truncated flat; and an exterior side surface extending between the base and the truncated flat, the exterior side surface and the truncated flat intersecting at a peripheral edge having a first arc having a first radius with a first center and a second arc having a second radius with a second center, wherein first center and the second center are not coincident in location on the truncated flat and the second radius is generally equal in dimension to the latch collar radius.

11. The lug post of claim 10, wherein the first arc and the second arc oppose each other on the peripheral edge.

12. The lug post of claim 11, wherein the first arc is delineated by a first radius originating from the first center and the second arc is delineated by a second radius originating from the second center, the first radius smaller in dimension than the second radius.

13. The lug post of claim 12, wherein the lug post is generally frustoconical in shape and the exterior side surface is generally conical in shape.

14. The lug post of claim 13, wherein the first arc comprises approximately 140° to 160° of the peripheral edge and the second arc comprises approximately 70° to 90° of the peripheral edge.

15. The lug post of claim 10, wherein the lug post further comprises a first beveled flat and a second beveled flat descending from the truncated flat toward the base.

16. The lug post of claim 15, wherein the first beveled flat and the second beveled flat intersect the peripheral edge between the first arc and the second arc.

17. An adapter for a ground-engaging tool, the adapter comprising:

an attachment structure configured to attach to a work implement;

a support nose extending from the attachment structure, the support nose having at an adapter surface and a lug post projecting from the adapter surface, the lug post being generally shaped as a frustum with an exterior side surface and a truncated flat intersecting at a peripheral edge, the peripheral edge delineated in part by at least a first radius originating from a first center on the truncated flat and a second radius originating from a second center on the truncated flat, wherein the first center and the second center are not coincident on the truncated flat, and wherein the first radius delineates a first arc on the peripheral edge and the second radius delineates a second arc on the peripheral edge, the first arc and the second arc located opposite each other.

18. The adapter of claim 17, wherein the second radius is larger in dimension than the first radius.

19. The adapter of claim 17, wherein the lug post the further comprises a first beveled flat and a second beveled flat descending from the truncated flat toward a base of the lug post; wherein the first beveled flat and the second beveled flat intersect the peripheral edge between the first arc and the second arc.

* * * * *